US007348957B2

(12) United States Patent
Cui et al.

(10) Patent No.: US 7,348,957 B2
(45) Date of Patent: Mar. 25, 2008

(54) REAL-TIME DYNAMIC DESIGN OF LIQUID CRYSTAL DISPLAY (LCD) PANEL POWER MANAGEMENT THROUGH BRIGHTNESS CONTROL

(75) Inventors: Ying Cui, Mountain View, CA (US); Richard W. Jensen, Fair Oaks, CA (US); David Wyatt, San Jose, CA (US); Venu M. Kuchibhotla, Campbell, CA (US); Sathyamurthi Sadhasivan, Eldorado Hills, CA (US); Todd M. Witter, Orangevale, CA (US)

(73) Assignee: Intel Corporation, Santa Clara, CA (US)

( * ) Notice: Subject to any disclaimer, the term of this patent is extended or adjusted under 35 U.S.C. 154(b) by 303 days.

(21) Appl. No.: 10/367,070

(22) Filed: Feb. 14, 2003

(65) Prior Publication Data

US 2004/0160435 A1 Aug. 19, 2004

(51) Int. Cl.
*G09G 3/28* (2006.01)

(52) U.S. Cl. ..... 345/102; 345/63; 345/207; 345/211; 345/212

(58) Field of Classification Search ..... 345/102, 345/63, 20, 207, 211–212
See application file for complete search history.

(56) References Cited

U.S. PATENT DOCUMENTS 5,488,434 A 1/1996 Jung
5,532,719 A 7/1996 Kikinis
5,745,770 A * 4/1998 Thangadurai et al. ..... 710/260
5,760,760 A * 6/1998 Helms ..... 345/102
5,854,617 A 12/1998 Lee et al.
5,875,345 A * 2/1999 Naito et al. ..... 713/323
6,111,559 A 8/2000 Motomura et al.
6,278,436 B1 * 8/2001 Hosoi et al. ..... 345/30
6,346,937 B1 2/2002 Sasaki et al.
6,388,388 B1 5/2002 Weindorf et al.
6,466,196 B1 10/2002 Isogawa et al.
6,552,749 B1 4/2003 Jones, Jr. et al.
6,553,153 B1 4/2003 Cui
6,611,249 B1 8/2003 Evanicky et al.

(Continued)

FOREIGN PATENT DOCUMENTS

EP 0 883 103 A1 12/1998

(Continued)

OTHER PUBLICATIONS

U.S. Appl. No. 10/378,116, filed Feb. 28, 2003, Jones, Jr. et al.

(Continued)

*Primary Examiner*—Richard Hjerpe
*Assistant Examiner*—Leonid Shapiro
(74) *Attorney, Agent, or Firm*—Derek Reynolds; Intel Corporation

(57) ABSTRACT

According to one embodiment of the present invention, a method of power management for a flat panel display is disclosed. The method includes: receiving image data; determining a segment mode for the received image data; selecting a portion of the received image data corresponding to the determined segment mode; accumulating a value of the selected portion of the received image data; comparing the accumulated value to a threshold value; and generating an interrupt signal if the accumulated value exceeds the threshold value.

27 Claims, 6 Drawing Sheets

U.S. PATENT DOCUMENTS

| | | | | |
|---|---|---|---|---|
| 6,633,687 | B1 | 10/2003 | Cui | |
| 6,647,501 | B1 * | 11/2003 | Ninomiya | 713/320 |
| 6,731,290 | B2 | 5/2004 | Cui | |
| 6,897,843 | B2 * | 5/2005 | Ayres et al. | 345/90 |
| 2001/0022584 | A1 | 9/2001 | Tsugawa | |
| 2002/0003522 | A1 | 1/2002 | Baba et al. | |
| 2002/0097916 | A1 * | 7/2002 | Kaizu | 382/232 |
| 2003/0001815 | A1 | 1/2003 | Cui | |
| 2003/0210247 | A1 | 11/2003 | Cui et al. | |
| 2004/0174369 | A1 | 9/2004 | Cui | |
| 2004/0233307 | A1 * | 11/2004 | Tsujino | 348/255 |

FOREIGN PATENT DOCUMENTS

| | | | |
|---|---|---|---|
| EP | 0 888 004 | A2 | 12/1998 |
| EP | 1 111 575 | A1 | 6/2001 |
| JP | 11 213090 | A | 8/1999 |
| JP | 2000330542 | A | 11/2000 |

OTHER PUBLICATIONS

PCT International Search Report for PCT International Application No. US02/18738, mailed Dec. 5, 2002 (5 pages).

* cited by examiner

REAL-TIME DYNAMIC DESIGN OF LIQUID CRYSTAL DISPLAY (LCD) PANEL POWER MANAGEMENT THROUGH BRIGHTNESS CONTROL

CROSS REFERENCE TO RELATED APPLICATIONS

This application is related to the following co-pending U.S. patent applications: 1) U.S. patent application No. 10/745,239 entitled, "Method and Apparatus for Characterizing and/or Predicting Display Backlight Response Latency", assigned to the assignee of the present invention and filed Dec. 22, 2003; 2) U.S. patent application No. 09/896,341 entitled "Method and Apparatus for Enabling Power Management of a Flat Panel Display," assigned to the assignee of the present invention and filed Jun. 28, 2001; 3) U.S. patent application No. 10/663,316 entitled, "Automatic Image Luminance Control with Backlight Adjustment", assigned to the assignee of the present invention and filed Sept. 15, 2003; and 4) U.S. patent application No. 10/882,446 entitled "Method and Apparatus to Synchronize Backlight Intensity Changes with Image Luminance Changes," assigned to assignee of the present application and filed Jun. 30, 2004.

COPYRIGHT NOTICE

Contained herein is material that is subject to copyright protection. The copyright owner has no objection to the facsimile reproduction of the patent disclosure by any person as it appears in the Patent and Trademark Office patent files or records, but otherwise reserves all rights to the copyright whatsoever.

FIELD OF THE INVENTION

The present invention generally relates to the field of electronic displays. More particularly, an embodiment of the present invention relates to real-time dynamic design of liquid crystal display (LCD) panel power management through brightness control.

BACKGROUND

Notebook (also called laptop) computers are lightweight personal computers, which are quickly gaining popularity. The popularity of the notebook computers has especially increased since their prices have been dropping steadily, while maintaining similar performance as their larger siblings (i.e., desktop computers or workstations). One clear advantage of notebook computers is their ease of portability. The lighter weight restrictions require the mobile platform manufacturers to produce images that compete with the desktop models, while marinating an increased battery life.

As more functionality is integrated within mobile computing platforms, the need to reduce power consumption becomes increasingly important. Furthermore, users expect increasingly longer battery life in mobile computing platforms, furthering the need for creative power conservation solutions. Mobile computer designers have responded by implementing power management solutions such as, reducing processor and chipset clock speeds, intermittently disabling unused components, and reducing power required by display devices, such as an LCD or "flat panel" display.

Generally, power consumption in flat-panel display monitors increases with flat panel display backlight brightness. In some computer systems, flat panel display backlight power consumption can soar as high as six Watts when the backlight is at maximum luminance. In a mobile computing system, such as a laptop computer system, this can significantly shorten battery life. In order to reduce flat panel power consumption and thereby increase battery life, mobile computing system designers have designed power management systems to reduce the flat-panel display backlight brightness while the system is in battery-powered mode. However, in reducing backlight brightness in a flat panel display, the user is often left with a display image that is of lower quality than when the mobile computing platform is operating on alternating current (AC) power. This reduction in image quality results from a reduction in color and brightness contrast when backlight brightness is reduced.

Image quality can be further affected by ambient light surrounding the display. This reduces the number of environments in which a user can use a mobile computing system comfortably.

BRIEF DESCRIPTION OF THE DRAWINGS

The invention is illustrated by way of example and not limitation in the figures of the accompanying drawings, in which like references indicate similar or identical elements, and in which.

DETAILED DESCRIPTION

In the following detailed description of the present invention numerous specific details are set forth in order to provide a thorough understanding of the present invention. However, it will be apparent to one skilled in the art that the present invention may be practiced without these specific details. In other instances, well-known structures and devices are shown in block diagram form, rather than in detail, in order to avoid obscuring the present invention.

Reference in the specification to "one embodiment" or "an embodiment" means that a particular feature, structure, or characteristic described in connection with the embodiment is included in at least one embodiment of the invention. The appearances of the phrase "in one embodiment" in various places in the specification are not necessarily all referring to the same embodiment.

Figure 1:
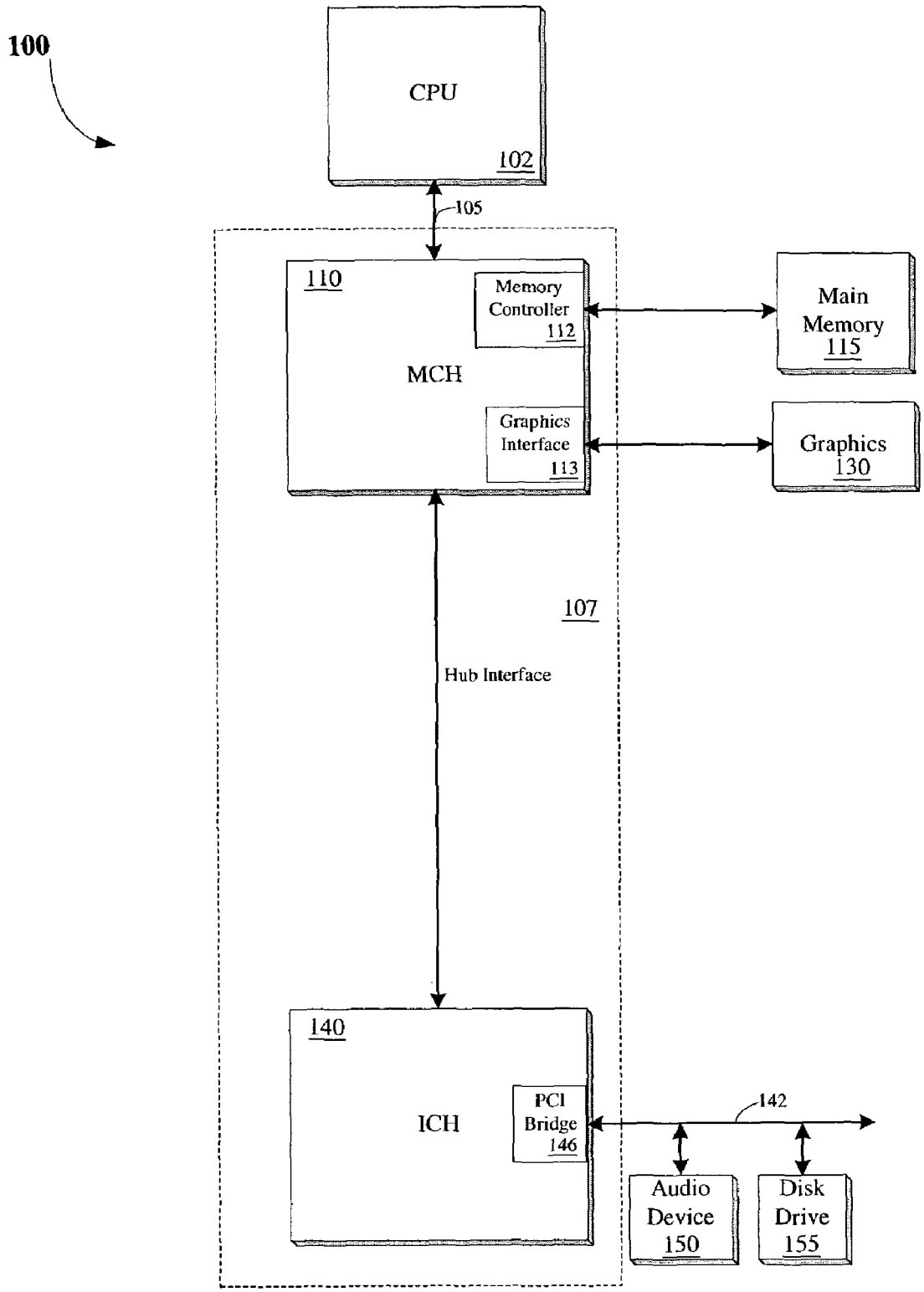
FIG. 1 illustrates an exemplary block diagram of a computer system 100 in accordance with an embodiment of the present invention.

FIG. 1 illustrates an exemplary block diagram of a computer system 100 in accordance with an embodiment of the present invention. The computer system 100 includes a central processing unit (CPU) 102 coupled to a bus 105. In one embodiment, the CPU 102 is a processor in the Pentium® family of processors including the Pentium® II processor family, Pentium® III processors, Pentium® IV processors available from Intel Corporation of Santa Clara, Calif. Alternatively, other CPUs may be used, such as Intel's XScale processor, Intel's Banias Processors, ARM processors available from ARM Ltd. of Cambridge, the United Kingdom, or OMAP processor (an enhanced ARM-based processor) available from Texas Instruments, Inc., of Dallas, Tex.

A chipset 107 is also coupled to the bus 105. The chipset 107 includes a memory control hub (MCH) 110. The MCH 110 may include a memory controller 112 that is coupled to a main system memory 115. Main system memory 115 stores data and sequences of instructions that are executed by the CPU 102 or any other device included in the system 100. In one embodiment, main system memory 115 includes dynamic random access memory (DRAM); however, main system memory 115 may be implemented using other memory types. Additional devices may also be coupled to the bus 105, such as multiple CPUs and/or multiple system memories.

The MCH 110 may also include a graphics interface 113 coupled to a graphics accelerator 130. In one embodiment, graphics interface 113 is coupled to graphics accelerator 130 via an accelerated graphics port (AGP) that operates according to an AGP Specification Revision 2.0 interface developed by Intel Corporation of Santa Clara, Calif. In an embodiment of the present invention, a flat panel display may be coupled to the graphics interface 113 through, for example, a signal converter that translates a digital representation of an image stored in a storage device such as video memory or system memory into display signals that are interpreted and displayed by the flat-panel screen. It is envisioned that the display signals produced by the display device may pass through various control devices before being interpreted by and subsequently displayed on the flat-panel display monitor.

In addition, the hub interface couples the MCH 110 to an input/output control hub (ICH) 140 via a hub interface. The ICH 140 provides an interface to input/output (I/O) devices within the computer system 100. The ICH 140 may be coupled to a Peripheral Component Interconnect (PCI) bus adhering to a Specification Revision 2.1 bus developed by the PCI Special Interest Group of Portland, Oregon. Thus, the ICH 140 includes a PCI bridge 146 that provides an interface to a PCI bus 142. The PCI bridge 146 provides a data path between the CPU 102 and peripheral devices.

The PCI bus 142 includes an audio device 150 and a disk drive 155. However, one of ordinary skill in the art will appreciate that other devices may be coupled to the PCI bus 142. In addition, one of ordinary skill in the art will recognize that the CPU 102 and MCH 110 could be combined to form a single chip. Furthermore, graphics accelerator 130 may be included within MCH 110 in other embodiments.

In addition, other peripherals may also be coupled to the ICH 140 in various embodiments. For example, such peripherals may include integrated drive electronics (IDE) or small computer system interface (SCSI) hard drive(s), universal serial bus (USB) port(s), a keyboard, a mouse, parallel port(s), serial port(s), floppy disk drive(s), digital output support (e.g., digital video interface (DVI)), and the like. Moreover, the computer system 100 is envisioned to receive electrical power from one or more of the following sources for its operation: a battery, alternating current (AC) outlet (e.g., through a transformer and/or adaptor), automotive power supplies, airplane power supplies, and the like.

Figure 2:
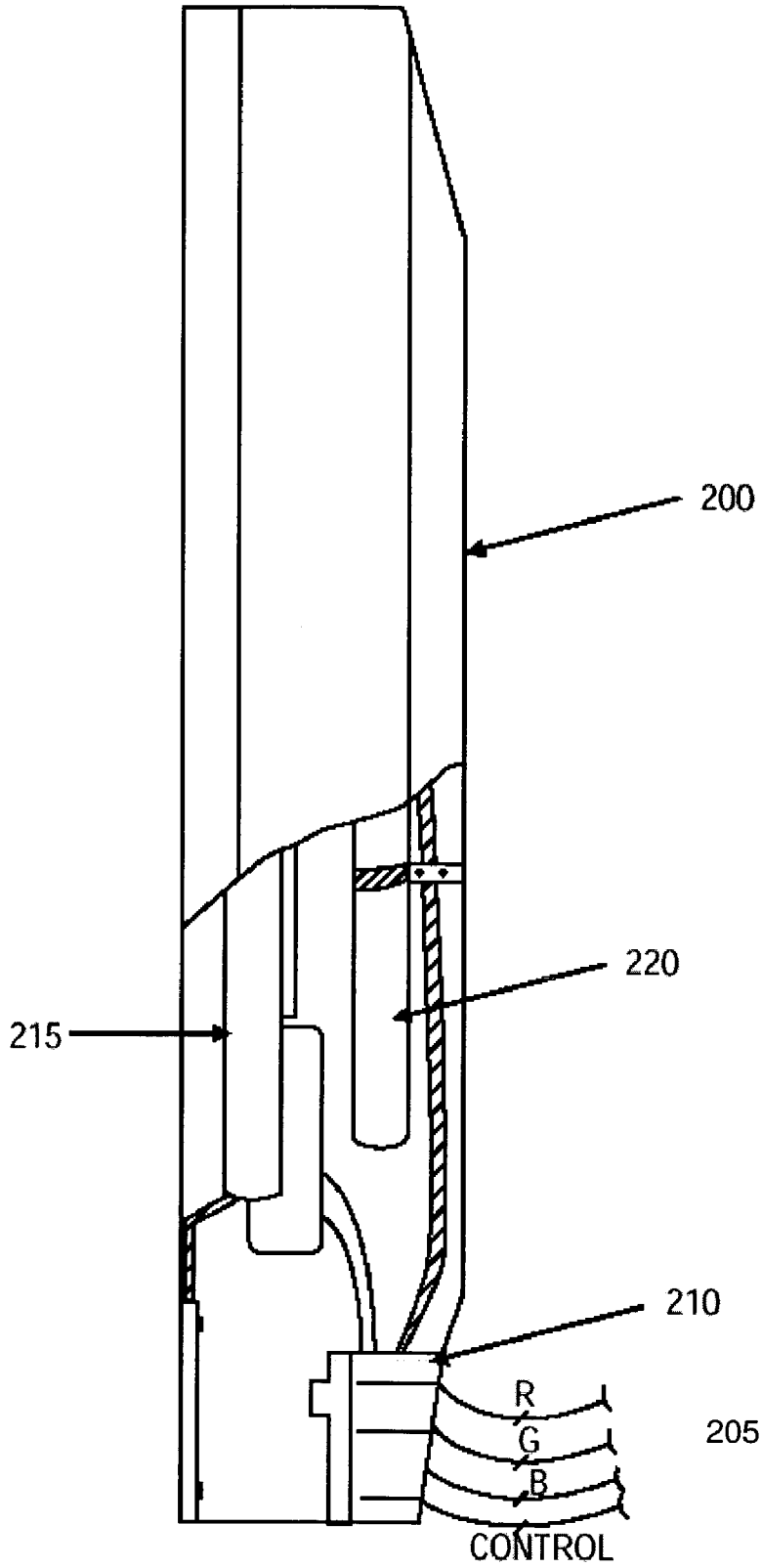
FIG. 2 illustrates an exemplary cross-section of a flat-panel display monitor 200 in accordance with an embodiment of the present invention.

FIG. 2 illustrates an exemplary cross-section of a flat-panel display monitor 200 in accordance with an embodiment of the present invention. In one embodiment, display signals 205 generated by a display device, such as a graphics accelerator, are interpreted by a flat-panel monitor control device 210 and subsequently displayed by enabling pixels within a flat-panel monitor screen 215. The pixels are illuminated by a backlight 220, the brightness of which effects the brightness of the pixels and therefore the brightness of the displayed image.

Figure 3:
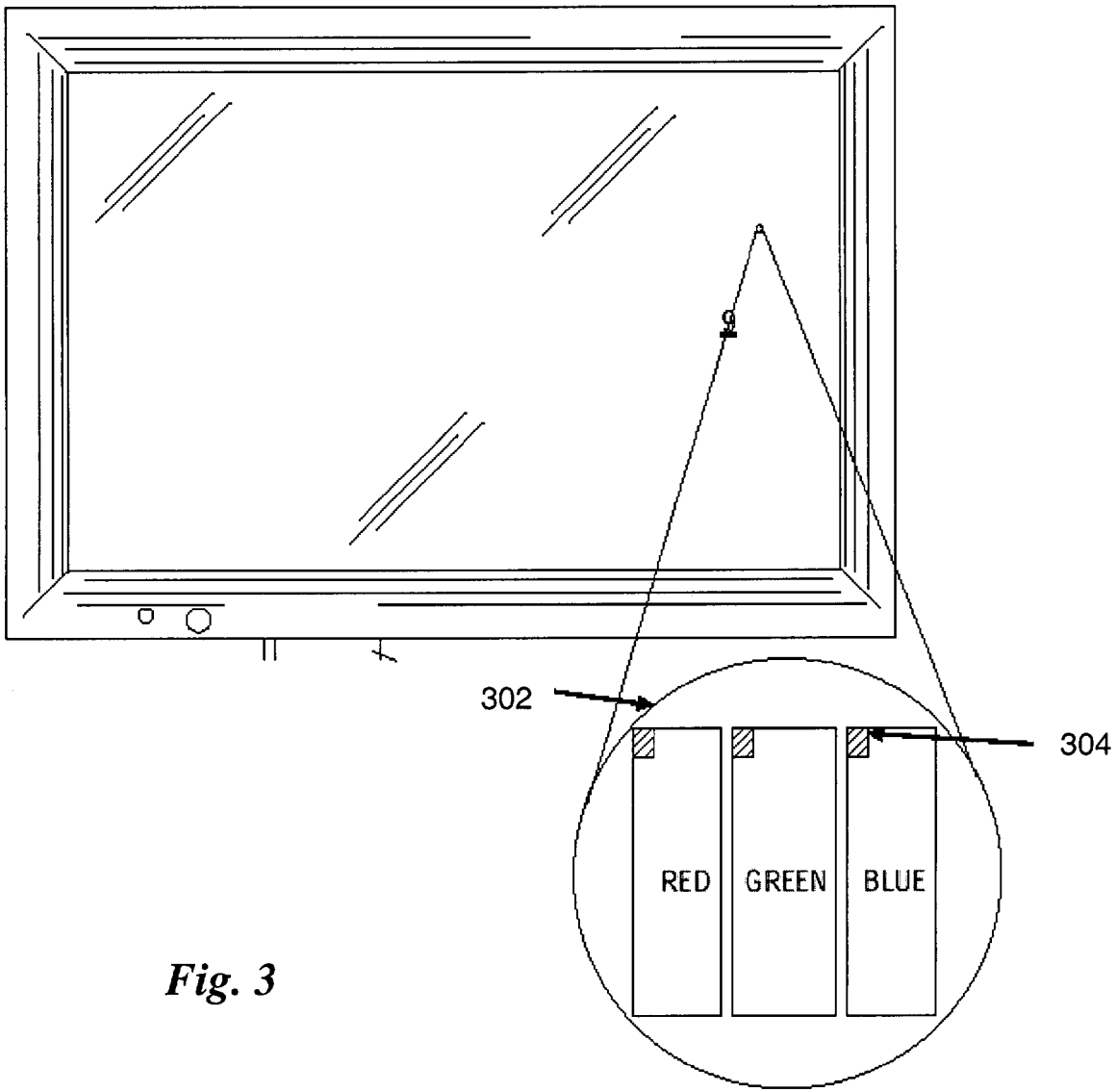
FIG. 3 illustrates a group of pixels within a flat-panel monitor screen in accordance with one embodiment.

FIG. 3 illustrates a group of pixels within a flat-panel monitor screen in accordance with one embodiment. In one embodiment, the pixels are formed using thin film transistor (TFT) technology, and each pixel is composed of three sub-pixels 302 that, when enabled, cause a red, green, and blue (RGB) color to be displayed, respectively. Each sub-pixel is controlled by a TFT 304. A TFT enables light from a display backlight to pass through a sub-pixel, thereby illuminating the sub-pixel to a particular color. Each sub-pixel color may vary according to a combination of bits representing each sub-pixel. The number of bits representing a sub-pixel determines the number of colors, or color depth, that may be displayed by a sub-pixel.

Accordingly, by increasing the number of bits that are used to represent each sub-pixel, the number of colors that each sub-pixel represents increases by a factor of 2N, where "N" is the color depth of a sub-pixel. For example, a sub-pixel represented digitally by 8 bits may display 28 or 256 colors. A brighter or dimmer shade of a color being displayed by a pixel can be achieved by scaling the binary value representing each sub-pixel color (red, green, and blue, respectively) within the pixel. The particular binary values used to represent different colors depends upon the color-coding scheme, or color space, used by the particular display device. By modifying the color shade of the sub-pixels (by scaling the binary values representing sub-pixel colors) the brightness of the display image may be modified on a pixel-by-pixel basis. Furthermore, by modifying the color shade of each pixel, the amount of backlight necessary to create a display image of a particular display image quality can be reduced accordingly.

Figure 4:
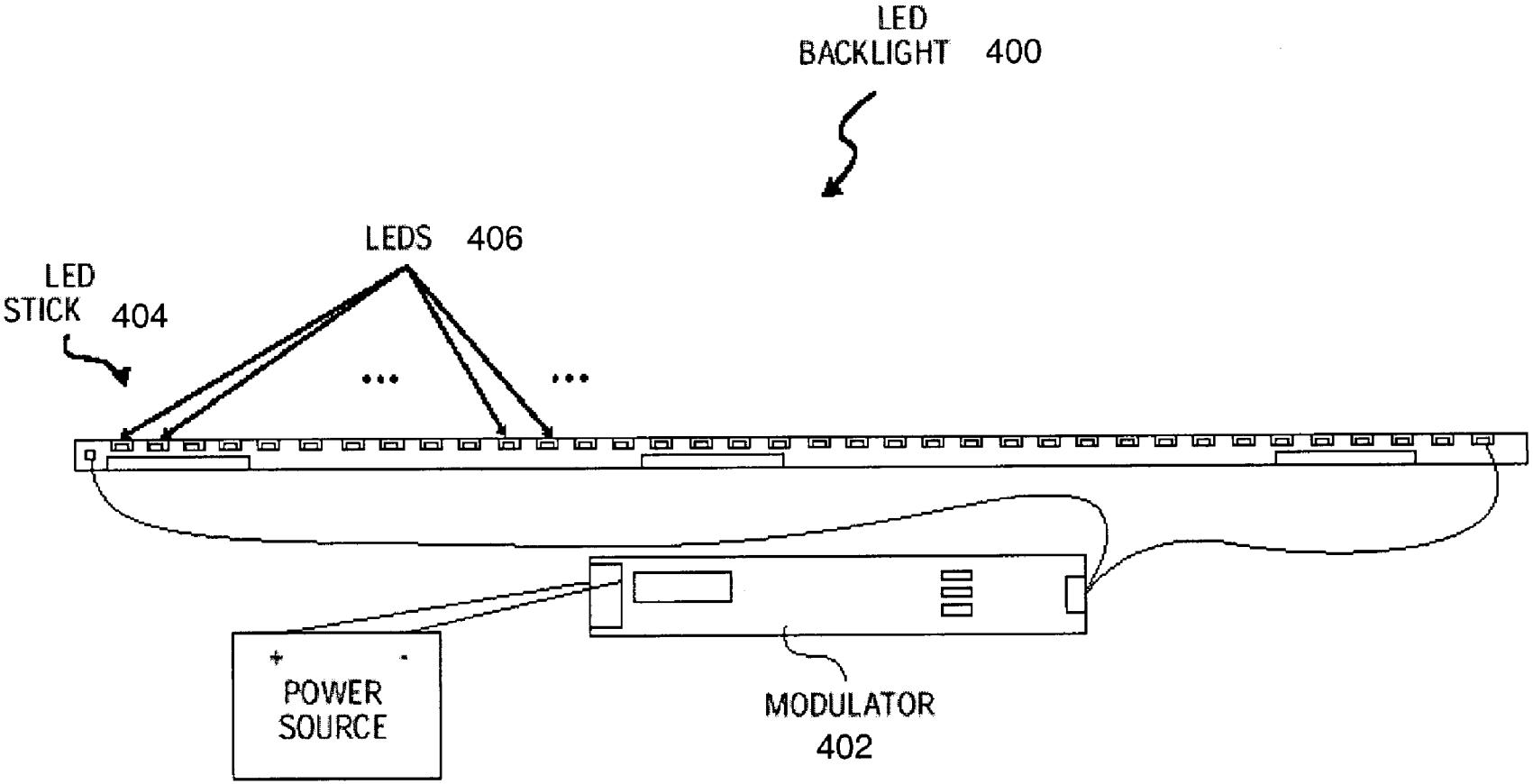
FIG. 4 illustrates a light emitting diode (LED) backlight for a notebook computer display system, according to one embodiment of the invention.

FIG. 4 illustrates a light emitting diode (LED) backlight for a notebook computer display system, according to one embodiment of the invention. According to an embodiment of the invention, the LED backlight 400 includes a modulator 402, and an LED stick 404. The LED stick 404 includes a number of LEDs 406. For example, according to an embodiment of the invention, the LED stick 404 includes 36 LEDs. In an alternative embodiment of the invention, the LED stick 404 includes 18 LEDs. According to other embodiments of the invention, the LED stick 404 includes a greater or lesser number of LEDs (e.g., 1 LED or 48 LEDs.). The LEDs 406 are blue LEDs, according to one embodiment of the invention. However, according to an alternative embodiment of the invention, the LEDs 406 are ultraviolet LEDs.

The modulator 402 receives power from a battery (e.g., a 12 Volt battery), according to an embodiment of the invention. According to an alternative embodiment of the invention, the modulator 402 receives power from a rectified AC power source (e.g., through a plug-in AC to DC adapter).

Typically, when non-white light is used to illuminate LCD systems, the non-white light is converted into light that may be used to display an image. For example, colored light is converted into light usable by the red, green, and blue color masks of an LCD matrix (i.e., the light is converted into red, green and blue light).

Figure 5:
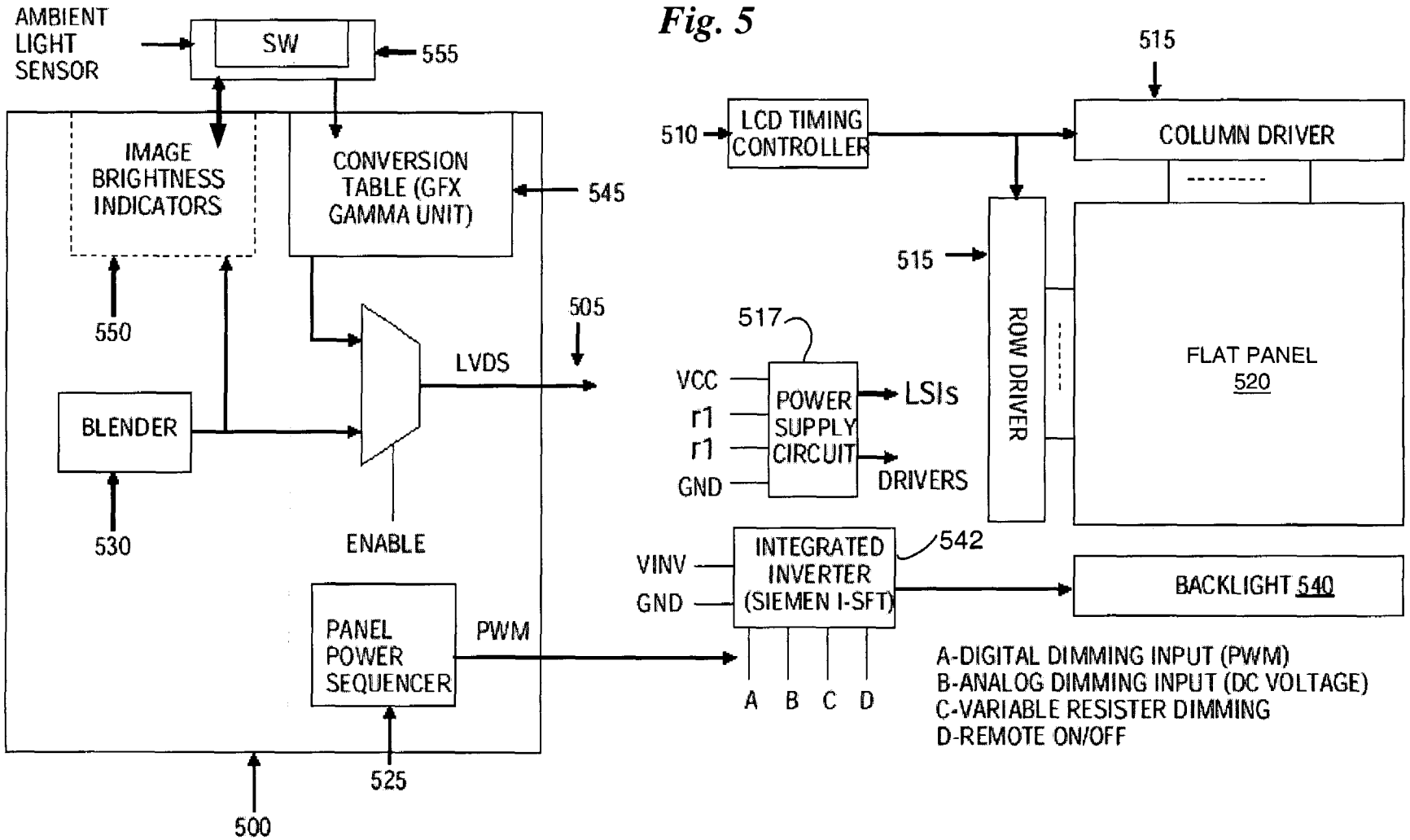
FIG. 5 illustrates a display system according to one embodiment.

FIG. 5 illustrates a display system according to one embodiment. In one embodiment, the direction of arrows shown in FIG. 5 indicates the direction of the data/signal flow between different components. In an embodiment, a display device 500 generates display signals 505, which enable an LCD timing controller 510 to activate appropriate column and row drivers 515 to display an image on a flat-panel display monitor 520. In an embodiment of the present invention, the display 520 may be an LCD or plasma display. A power supply 517 may provide power to the drivers 515 and other large-scale integration (LSI) circuits.

In one embodiment, the display device includes a panel power sequencer (PWM) 525, a blender unit 530, and a graphics gamma unit 545. The PWM may control luminance (brightness) of a backlight 540 within the flat-panel display monitor. As illustrated in FIG. 5, the PWM may be incorporated with other signals (e.g., analog dimming input (B), variable resister dimming (C), and/or remote on/off control (D)) through an integrated inverter 542. In one embodiment, the integrated inverter 542 may be a industry Siemens flat panel display technology (I-SFT) inverter for the backlight 540.

In an embodiment, the blender unit 530 creates an image to be displayed on the display monitor by combining a display image with other display data, such as texture(s), lighting, and/or filtering data.

In one embodiment of the present invention, the display image from the blender unit 530 and the output of the gamma unit 545 can be combined to create a low voltage display signal (LVDS) 505, which is transmitted to a flat-panel display device. The LVDS signal 505 may be further translated into other signal types in order to traverse a greater physical distance before being translated to an appropriate display format and subsequently displayed on monitor such as a flat-panel display.

In a further embodiment, the graphics gamma unit 545 effects the brightness of an image to be displayed on the display monitor by scaling each sub-pixel color. In one embodiment, the graphics gamma unit 545 can be programmed to scale the sub-pixel color on a per-pixel basis in order to achieve greater brightness in some areas of the display image, while reducing the brightness in other areas of the display image.

FIG. 5 further illustrates one embodiment in which a unit 550 containing image brightness indicators samples the display image prior to it being translated to the LVDS format. The display image brightness indicators detect a display image brightness by monitoring and accumulating pixel color within the display image. The display image brightness indicators can then indicate to a software program (555) the brightness of certain features within the display image, such as display image character and background brightness. In an embodiment, the software program 555 receives ambient light sensor information to determine the environment the display is being used in to, for example, adjust the display characteristics (such as brightness and/or contrast) accordingly.

Figure 6:
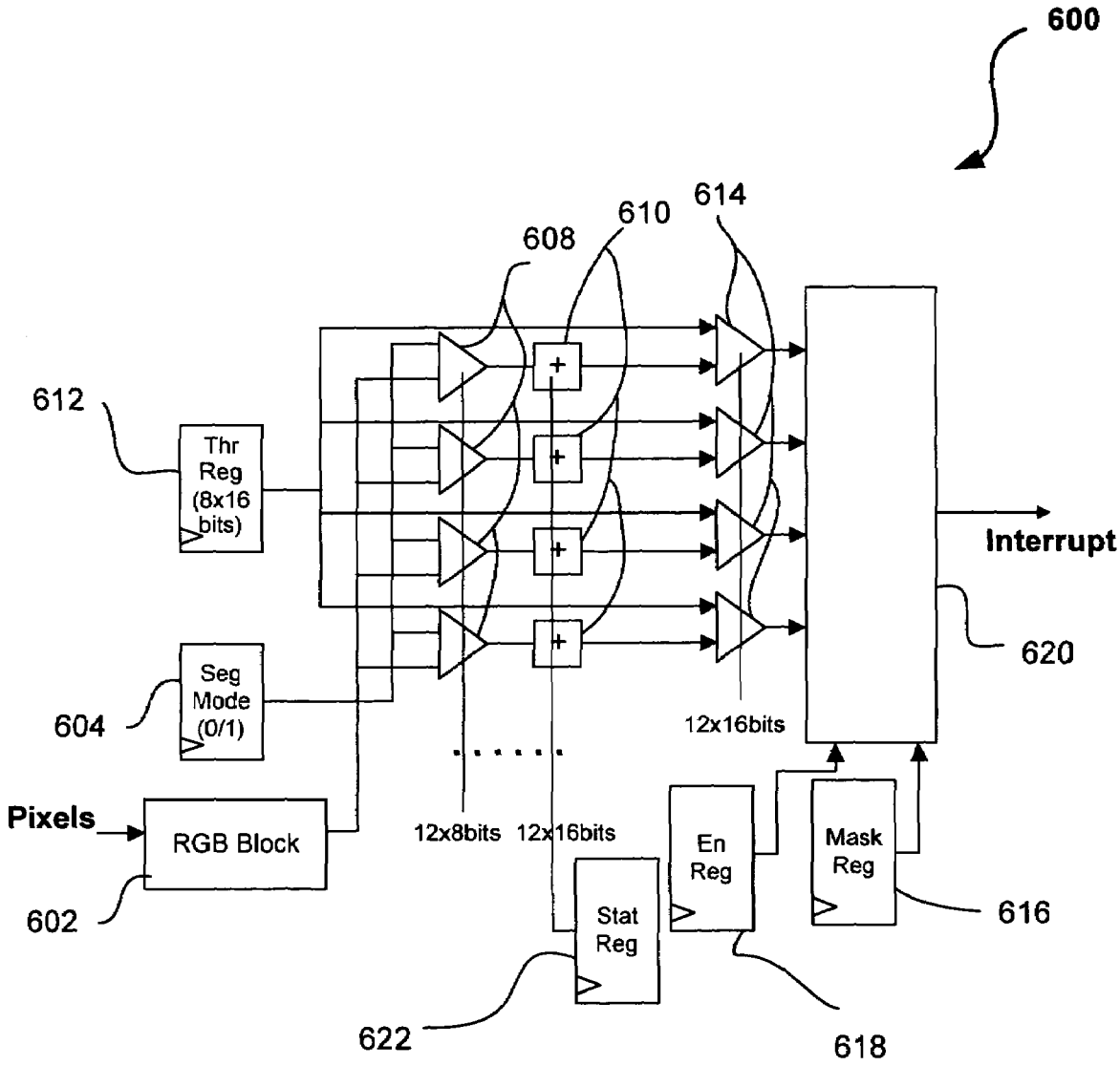
FIG. 6 illustrates an exemplary block diagram of a backlight modulation circuit 600 in accordance with an embodiment of the present invention.

FIG. 6 illustrates an exemplary block diagram of a backlight modulation circuit 600 in accordance with an embodiment of the present invention. In one embodiment, the backlight modulation circuit 600 illustrates the internal operation of the image brightness indicators unit 550 of FIG. 5. In an embodiment, the backlight modulation circuit 600 is envisioned to define a way of increasing image brightness and reducing back light brightness thus scaling down the LCD back light power consumption by about 30-70% in battery mode.

In one embodiment, the backlight modulation can be performed in singlewide display mode using the original image data. In singlewide display mode (i.e., 1 pixel per clock cycle), when back light modulation is enabled, the original image data may be used to calculate the brightness indicators and the interrupt which is in turn used by the software (such as the software unit 555 of FIG. 5) to modify the displayed image. The output of a gamma correction block (not shown), which also receives the original image data can be used by a panel fitter to perform panel fitting. In a further embodiment of the present invention, the back light modulation may be disabled in dual-display mode.

In one embodiment, the gamma correction block, which may be implemented by three lookup table (LUT) random access memories (RAMs), one for each color component. Essentially, each of the LUT RAMs may act the same way, but with different data inputs. There may be three modes of operation. Data can go straight through without gamma correction, a straight look-up can occur providing an 8-bit precision output, or a combination look-up and mathematical operation can yield 10-bits of accuracy.

The circuit 600 includes a red, green, and blue (RGB) adjustment block 602. In an embodiment of the present invention, the output of the RGB block is eight bits wide. The RGB block 602 receives image data after gamma correction (or otherwise as described above) and manipulates the RGB data for each set of pixel data to calculate a Y function. This is done for all the pixel data until the end of the frame is reached. In an embodiment of the present invention, the end of the frame may be indicated by a video blank (VBlank) signal. In an embodiment, the Y function is calculated by the following formula:

$$Y=0.299*R+0.587*G+0.114*B$$

where R represents the value of red, G represents the value of green, and B represents the value of blue.

The Y function may be implemented as follows:

$$Y=(1;4+1;32+1;64)*R+(1;2+1;16+1;64+1;128)*G+(1;8)*B$$

which in turn results in:

$$Y=0.296875*R+0.5859375*G+0.125*B$$

Accordingly, the binary implementation may result in an error of about 0.0021 for R, 0.0010 for G, and 0.011 for B.

The circuit 600 further includes a segment mode register 604. In an embodiment of the present invention, the mode value may be 0 for selection of bits 0 to 7 and 1 for selection of bits 0 to 15 (i.e., 8 bits per pixel for mode 0 and 16 bits per pixel for mode 1). The output of the RGB block 602 and the segment mode register 604 (as a selection control, e.g., one-bit wide) are provided to a bank of comparators 608. The segment mode register 604 stores the mode value for the segment being processed by the circuit 600. In an embodiment of the present invention, the Y[9:2] can take values from 0 to 255. Part of 255 spectrum consist of eight segments, with two modes for segment definition (lower 16,16,16,16, and upper 16,16,16,16) and (lower 16,16,32, 32, and upper 32,32,16,16). There are 16-bit accumulators for each of the segments (610) and the segment corresponding to the value of Y[9:2] will be incremented (i.e., the corresponding counter 610).

The circuit 600 further includes a threshold register 612 to store desired threshold values. In an embodiment of the present invention, the output of the threshold register 612 is 16 bits wide. The output of the comparators 608 and the threshold register 612 are provided to a bank of comparators 614. Accordingly, depending on the segment mode select bit (e.g., stored in the segment mode register 604), the accumulated values in the (12×16 bits) segment accumulation registers (e.g., the counters 610) are compared against the threshold register (612).

In an embodiment, based on the interrupt mask (e.g., stored in a mask register 616) and interrupt enable bits (e.g., stored in an enable register 618), an interrupt is generated by an image brightness comparator block 620. In one embodiment of the present invention, the interrupt is an OR function of all the interrupt enabled segments. In a further embodiment of the present invention, the output of the enable register 618 and the mask register 616 are 12 bits wide each. In an embodiment of the present invention, the enable register 618 stores enable bit information base on which bit is to be enabled for the interrupt generation (e.g., as determined by the controlling software module such as the software unit 555 of FIG. 5).

The circuit 600 further includes a status register 622, which receives its input from the counters 610 and provides the data to the controlling software module (e.g., the software unit 555 of FIG. 5). In an embodiment of the present invention, the status register 622 is updated at the end of each frame. In one embodiment of the present invention, based on the backlight PWM signal (such as that discussed with respect to the panel power sequencer 525 of FIG. 5), PWM clock is generated. In an embodiment, the PWM cycle is programmable from 1K to 10k and the duty cycle is programmable to 64K levels. The PWM cycle may be utilized to indicate the percentage brightness of all turned-on pixels.

In one embodiment, the PWM implementation includes two counters; counter 1 is initialized to back light PWM register bits [15:0]and counter 2 is initialized to back light PWM register bits [31:16]on reset. Each of these counters decrement at each clock cycle. PWM signal is asserted (e.g., high) until counter 2 reaches 0 and then PWM signal is deasserted (e.g., low) until counter 1 reaches 0. When counter 1 reaches 0, both the counters are reset to values from the registers.

In a further embodiment, the controlling software module (e.g., the software unit 555 of FIG. 5) loads the LUT unit with appropriate values when the threshold interrupt is generated by the image brightness comparator block 620. Any change in values is not envisioned to cause noticeable tearing, however, in such situations the software may load intermediate values to smooth out the transition.

In accordance with some embodiments, the backlight brightness of a flat-panel display monitor controlled from a computer system may be adjusted to satisfy a computer system power consumption target when the computer system is operating on either battery power or AC power. In order to maintain a pre-determined display image quality, a display image brightness may then be detected and adjusted in response to adjusting the flat-panel display monitor backlight brightness. In one embodiment, the display image brightness is detected by display image detectors that indicate display image brightness to a software program. The software program may then configure a device, such as a graphics gamma unit, to adjust the display image brightness, while the power consumption target is achieved or maintained.

In accordance with an embodiment of the present invention, in order to maintain a display image quality, a display image should be illuminated within an acceptable range. Display image luminance may be effected by either increasing display image brightness (by varying the color shade of individual pixels) or increasing backlight brightness. In one embodiment of the present invention, the latter is undesirable in mobile computer systems that rely on battery power to operate, as the backlight tends to consume a significant amount of power.

In accordance with another embodiment of the present invention, the backlight brightness in a flat-panel display monitor is decreased while maintaining the displayed image quality. Furthermore, the display image brightness may be adjusted in order to achieve or maintain a display image quality regardless of variances in backlight brightness of a flat-panel display or ambient light brightness surrounding a flat-panel display.

Whereas many alterations and modifications of the present invention will no doubt become apparent to a person of ordinary skill in the art after having read the foregoing description, it is to be understood that any particular embodiment shown and described by way of illustration is in no way intended to be considered limiting. For example, the techniques described herein may be equally beneficial in non-mobile platforms (such as desktop or workstation computer systems) to reduce power consumption. Also, even though embodiments of the present invention discuss RGB images, similar techniques may be applied to luminance-bandwidth-chrominance (YUV) images. Therefore, references to details of various embodiments are not intended to limit the scope of the claims which in themselves recite only those features regarded as essential to the invention.

What is claimed is:

1. A power management method comprising:

receiving image data;

determining a color depth of the received image data;

selecting at least a portion of the received image data, wherein the portion of the received image data includes data for one or more of a plurality of pixels of the received image data;

accumulating a brightness value of the selected portion of the received image data, wherein the brightness of each of the one or more pixels within the selected portion is calculated using the determined color depth;

comparing the accumulated brightness value to a threshold value; and generating an interrupt signal if the accumulated brightness value exceeds the threshold value.

2. The method of claim 1 further including providing the interrupt signal to a software module to control a brightness of a display.

3. The method of claim 2 wherein the software module controls the brightness of the display based on ambient light sensor information.

4. The method of claim 1, wherein each of the one or more pixels comprises a plurality of sub-pixels.

5. The method of claim 4, further comprising:

modifying a color shade of each of the plurality of sub-pixels, when the interrupt signal has been generated.

6. The method of claim 1 wherein the image data is in a format selected from a group comprising RGB and YUV.

7. The method of claim 1 further including calculating a Y function of the received image data prior to the selecting act.

8. The method of claim 7 wherein the Y function for an RGB formatted image data is calculated by:

$$0.299*R+0.587*G+0.114*B.$$

9. The method of claim 7 wherein the Y function for an RGB formatted image data is calculated by:

$$(1;4+1;32+1;64)*R+(1;2+1;16+1;64+1;128)*G+(1;8)*B.$$

10. The method of claim 1 further including updating a status register at an end of each frame of the received image data.

11. A computer system comprising:

a central processing unit (CPU);

a chipset coupled to the CPU;

a flat panel display to display an image;

a backlight modulation circuit coupled to the flat panel display and the chipset to increase image brightness and reducing backlight brightness to reduce power consumption of the flat panel display.

12. The computer system of claim 11 wherein the backlight brightness is reduced to achieve a power consumption reduction of about 30% to about 70%.

13. The computer system of claim 11 wherein the backlight modulation circuit includes:

a bank of comparators;

a threshold register and a bank of accumulators coupled to the bank of comparators, the bank of comparators generating an interrupt signal if a value provided by the bank of accumulators exceeds a threshold value provided by the threshold register.

14. The computer system of claim 13 further including a segment mode register to select a portion of received image data to be displayed on the flat panel display.

15. The computer system of claim 11 further including an enable register to enable a generation of an interrupt signal.

16. The computer system of claim 11 further including a mask register to enable a generation of an interrupt signal.

17. The computer system of claim 11 further including a status register to indicate an end of a frame of image data being processed by the backlight modulation circuit.

18. An article of manufacture comprising:

a machine readable medium that provides instructions that, if executed by a machine, will cause the machine to perform operations including:

receiving image data;

determining a color depth of the received image data;

selecting at least a portion of the received image data, wherein the portion of the received image data includes data for one or more of a plurality of pixels of the received image data;

accumulating a brightness value of the selected portion of the received image data, wherein the brightness of each of the one or more pixels within the selected portion is calculated using the determined color depth;

comparing the accumulated brightness value to a threshold value; and generating an interrupt signal if the accumulated brightness value exceeds the threshold value.

19. The article of claim 18 wherein the operations further include providing the interrupt signal to a software module to control a brightness of a display.

20. The article of claim 19 wherein the software module controls the brightness of the display based on ambient light sensor information.

21. The article of claim 18 wherein each of the one or more pixels comprises a plurality of sub-pixels.

22. The article of claim 21, further comprising:

modifying a color shade of each of the plurality of sub-pixels, when the interrupt signal has been generated.

23. The article of claim 18 wherein the image data is in a format selected from a group comprising RGB and YUV.

24. The article of claim 18 wherein the operations further include calculating a Y function of the received image data prior to the selecting operation.

25. The article of claim 24 wherein the Y function for an RGB formatted image data is calculated by:

$$0.299*R+0.587*G+0.114*B.$$

26. The article of claim 24 wherein the Y function for an RGB formatted image data is calculated by:

$$(1;4+1;32+1;64)*R+(1;2+1;16+1;64+1;128)*G+(1;8)*B.$$

27. The article of claim 18 wherein the operations further include updating a status register at an end of each frame of the received image data.

* * * * *